US005150897A

United States Patent [19]

Wortman

[11] Patent Number: 5,150,897

[45] Date of Patent: Sep. 29, 1992

[54] SPORT STRIKING ARTICLES

[76] Inventor: Alex Wortman, 1705 Wells, Ann Arbor, Mich. 48104

[21] Appl. No.: 621,794

[22] Filed: Dec. 4, 1990

[51] Int. Cl.[5] ..... A63B 59/06

[52] U.S. Cl. ..... 273/72 R; 273/26 B

[58] Field of Search ..... 273/72, 67, 26, 73 C, 273/73 L; 446/220, 221, 222, 226

[56] References Cited

U.S. PATENT DOCUMENTS

| | | | |
|---|---|---|---|
| Re. 31,811 | 1/1985 | Foreman | 273/72 A |
| 300,360 | 6/1884 | Gray | 273/72 R |
| 377,686 | 2/1888 | Moose | 273/72 R |
| 2,935,321 | 5/1960 | Lhotka | 273/67 R |
| 2,987,317 | 6/1961 | Acevedo | 273/67 R |
| 3,048,399 | 8/1962 | Breitbach | 273/26 B |
| 3,999,756 | 12/1976 | Head | 273/73 C |
| 4,343,467 | 8/1982 | Newcomb et al. | 273/26 B |
| 4,546,976 | 10/1985 | Jones | 273/72 R |
| 4,880,234 | 11/1989 | Salisbury | 273/73 L |
| 4,917,382 | 4/1990 | Hendershott | 273/72 R |

FOREIGN PATENT DOCUMENTS

| | | | |
|---|---|---|---|
| 2146538 | 4/1985 | United Kingdom | 273/72 R |

*Primary Examiner*—Paul E. Shapiro
*Assistant Examiner*—Mark S. Graham
*Attorney, Agent, or Firm*—Harness, Dickey & Pierce

[57] ABSTRACT

A collapsible sport striking instrument is provided having an elongated member and oppositely disposed handle and hitting ends. The instrument is constructed such that the hitting profile defined by the diameter of the bat adjacent to its hitting end can be made larger thereby improving the chances of hitting a ball with the bat. The instrument of this invention is collapsible or deployable such that storing and transporting the device is facilitated.

3 Claims, 4 Drawing Sheets

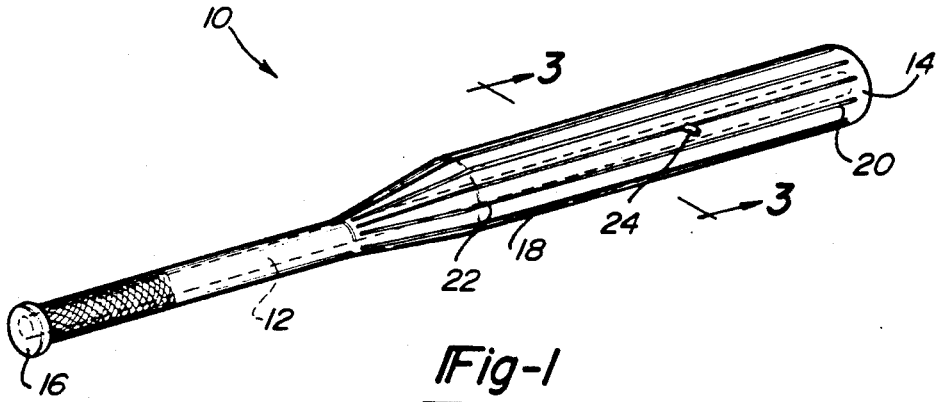
Fig-1
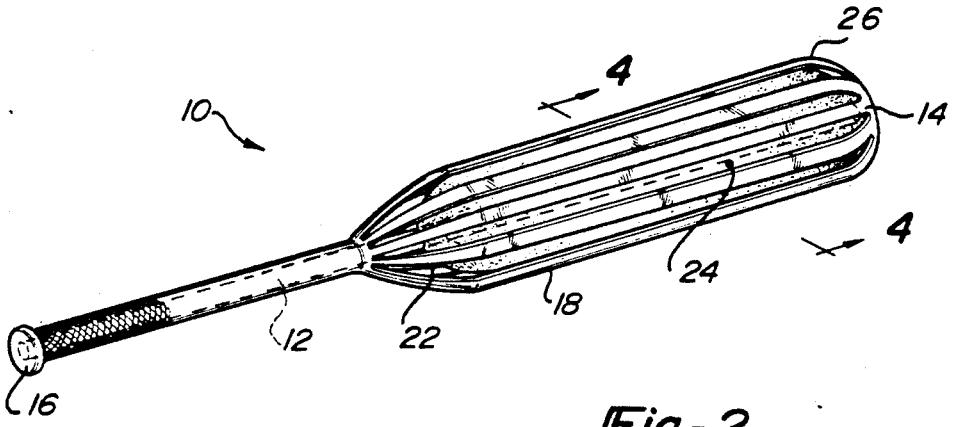
Fig-2
Fig-3
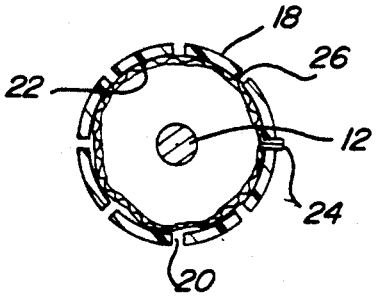
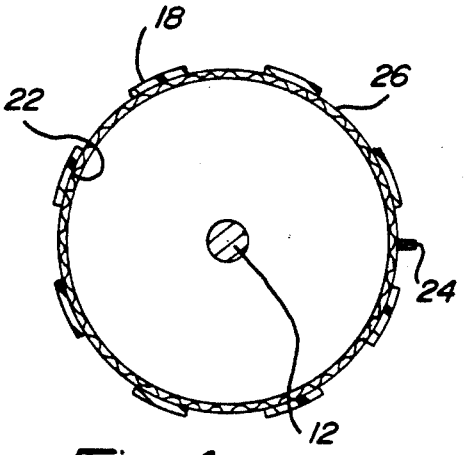
Fig-4

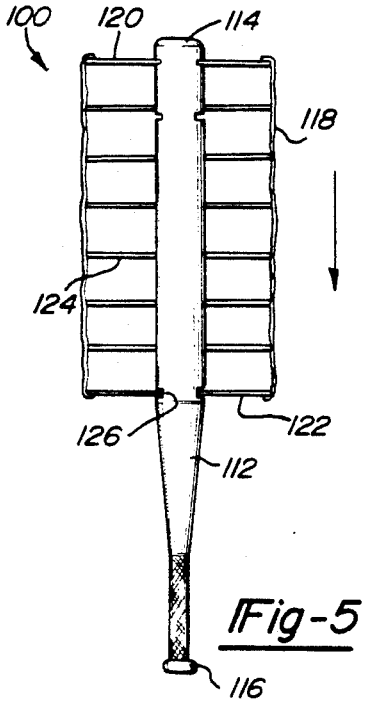
Fig-5
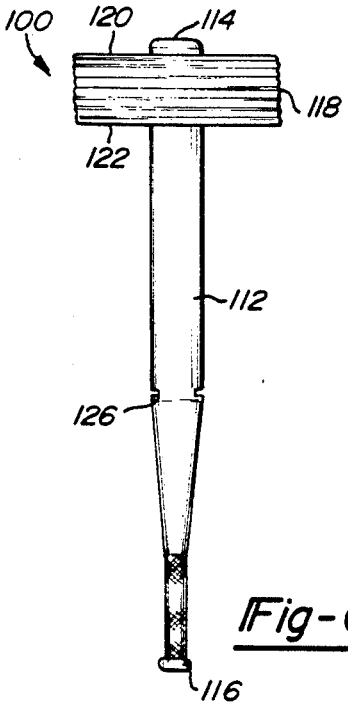
Fig-6
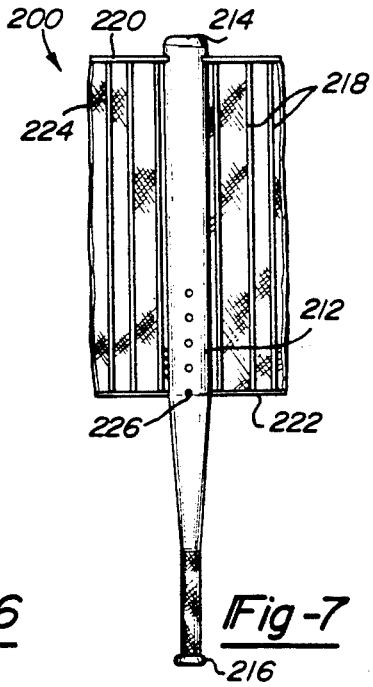
Fig-7
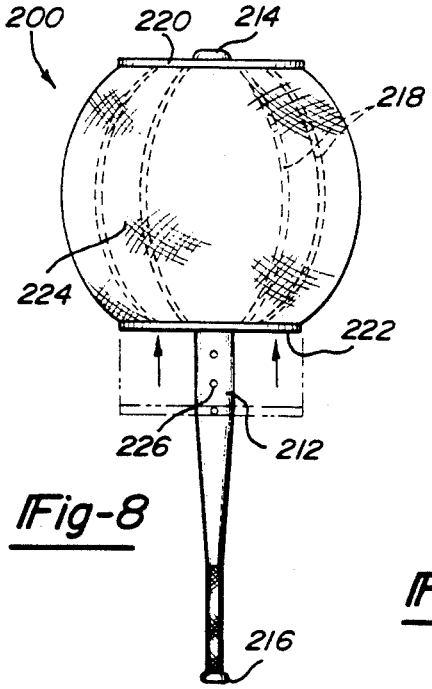
Fig-8
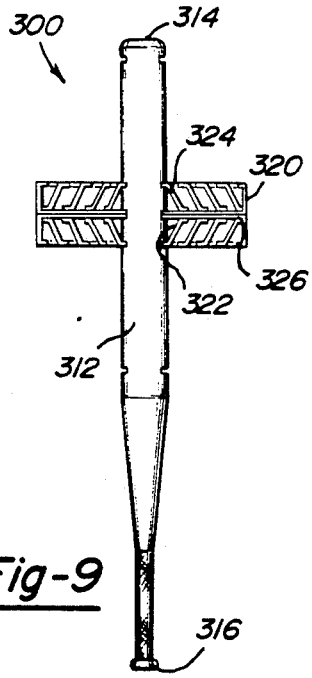
Fig-9
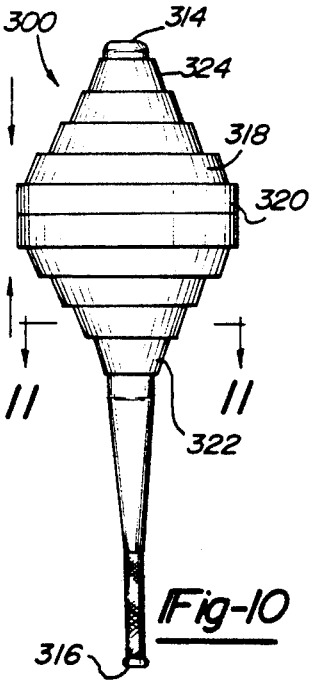
Fig-10
Fig-11
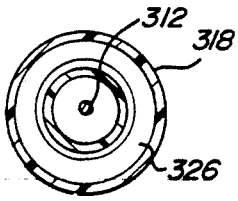

SPORT STRIKING ARTICLES

BACKGROUND OF THE INVENTION

1. Field of the invention

The present invention generally relates to sport striking articles such as bats used in the game of baseball and softball. More specifically, this invention relates to striking articles having an enlargable or collapsable profile shape.

2. Description of the prior art

The game of softball and baseball is a popular sport, for participants of all ages. However, it is well known that young children experience considerable difficulty in their early attempts to learn how to hit a baseball or softball. It takes a fair amount of eye to hand coordination and fluidity of swinging motion to successfully make contact and hit the ball any reasonable distance. It is difficult for most youngsters to experience success when they are being asked to take the instrument that is in their hands and effectively strike the moving target that is coming their way. Because of the difficulties involved, many attempts have been made to make the task easier for youngsters. For example, enlarged lightweight plastic bats are well known in the prior art.

For many youngsters, however, the lightweight plastic bats of the prior art are not large enough for the child to be successful. The reason for this lack of larger bats is that a very large bat is difficult to package and ship for the manufacturer, and is difficult and impractical to store for the retailer and user too. A very large bat which is four times or more as large as an average size wooden bat becomes a nuisance.

The prior art has suggested inflatable bats so as to overcome the aforementioned problems. U.S. Pat. No. 4,917,382 to Hendershott is an example of this type of inflatable bat. However, such inflatable bats generally do not provide sufficient rigidity to hit the ball any reasonable distance and does not have a handle sized for grasping by a child. Moreover, the device according to Hendershott does not enable the user to vary the size of the bat in use. Accordingly, what is needed is a child's toy bat which can be selectively enlarged to provide a greater hitting profile, but which retains sufficient rigidity to be capable of hitting a ball a reasonable distance.

SUMMARY OF THE INVENTION

According to the present invention there is provided a collapsable bat which can be readily transported and stored. The collapsable bat is generally formed as an elongated member having a handle end and an oppositely disposed hitting end. Adjacent the hitting end of the bat is a portion of the bat which defines the hitting profile. The size of the hitting profile is determined by the diameter of the bat in this portion. An inventive feature of the present invention is that the collapsable bat's hitting profile can be greatly increased while maintaining sufficient rigidity to the bat to hit the ball a reasonable distance. The hitting profile of the bat can be significantly enlarged to greatly improve the chances that the child will hit the ball. As will be discussed below, the bat's hitting profile may be enlarged through various means. Yet, the hitting profile may be collapsed such that the bat can be readily stored for later use.

Accordingly, it is an object of the present invention to provide a bat which will assist young beginners in hitting a ball by providing an enlargable hitting profile.

It is further object of this invention that such a bat be collapsable to make it practical for packaging, shipping, transporting, and storing.

Other objects and advantages of this invention will be more apparent after a reading of the following detailed description taken in conjunction with the drawings provided.

BRIEF DESCRIPTION OF THE DRAWINGS

FIG. 1 is an elevational view of a collapsable bat with an enlargable profile according to a first embodiment of the present invention.

FIG. 2 shows the collapsable bat of FIG. 1 with the hitting profile enlarged.

FIG. 3 is a cross-sectional view of the collapsable bat of FIG. 1.

FIG. 4 is a cross-sectional view of the collapsable bat of FIG. 2.

FIG. 5 is an elevational view of a collapsable bat in accordance with second embodiment of the present invention.

FIG. 6 shows the collapsable bat of FIG. 3 in which the hitting profile has been collapsed.

FIG. 7 is an elevational view of a collapsable bat in accordance with the third embodiment of the present invention.

FIG. 8 shows the collapsable bat of FIG. 5 in which the hitting profile has been enlarged.

FIG. 9 is an elevational view of a collapsable bat in accordance with a fourth embodiment of the present invention.

FIG. 10 shows the collapsable bat of FIG. 7 in which the hitting profile has been enlarged.

FIG. 11 is an elevational side view of an annular member in accordance with the fourth embodiment of the present invention.

DETAILED DESCRIPTION OF THE PREFERRED EMBODIMENT

Figure 12:
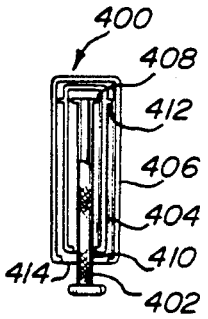
FIG. 12 is a cut-away view of a collapsable bat in accordance with a fifth embodiment of this invention which is in its collapsed condition.

In a first embodiment of the present invention, a collapsable bat 10 is provided having an elongated member 12 having a handle end 16 and a hitting end 14. As seen in FIG. 1, the collapsable bat 10 has a hitting profile defined by a hitting portion 18 located generally adjacent the hitting end 14 of the collapsable bat 10. A plurality of longitudinal slits 20 are disposed upon the surface of the collapsable bat 10 which defines the hitting portion 18. A cavity 22 is enclosed within the hitting portion 18 of the collapsable bat. The slits 20 are contiguous with and communicate with the cavity 22. In this first embodiment, a inflatable bladder 26 resides within the cavity 22. The inflatable bladder 26 is provided with an inflation nozzle 24 such that the inflatable bladder 26 may be inflated or deflated as desired.

As shown in FIG. 2, with the inflatable bladder 26 inflated, the hitting portion 18 of the collapsable bat 10 is greatly enlarged, defining a greatly enlarged hitting profile. A significant advantage to the construction of the first embodiment is that the surfaces of the hitting portion 18 between the slits 20 provide rigidity along the longitudinal length of the collapsable bat 10. Rigidity of the collapsable bat 10 can be further enhanced by having the elongated member 12 run the entire length of the collapsable bat through the axial center of the cavity 22, as indicated in FIGS. 3 and 4. Stiffness of the collapsable bat 10 can be further assured by forming the collapsable bat 10 from a durable plastic. However, it is equally important that the material from which the collapsable bat 10 is formed is resilient such that upon deflation of the inflatable bladder 26, the hitting profile returns to its original size shown in FIG. 1.

In a second embodiment of this invention, a collapsable bat 100 is provided as shown in FIG. 5. The collapsable bat 100 is generally comprised of an elongated member 112 having a handle end 116 and a hitting end 114. Disposed adjacent the hitting end 114 is a first disc 120. The first disc 120 may be rigidly attached to the elongated member 112. A second disc 122 is provided between the handle end 116 and the first disc 120. The second disc 122 is slidably mounted on the elongated member 112 such that it can traverse the length between the handle end 116 and the first disc 120. Attached to the first disc 120 and the second disc 122 is a collapsable sleeve 118. The collapsable sleeve 118 is generally tubular such that it encloses that portion of the elongated member 112 between the first disc 120 and the second disc 122. Also provided are a number of intermediate discs 124 between the first disc 120 and the second disc 122. The intermediate discs 124 are also slidable along the length of the elongated member 112. The collapsable sleeve 118 is attached to each of the intermediate discs 12 at their perimeter.

When stored, the collapsable bat 10 is as seen in FIG. 6. For use, the second disc 122 is traversed toward the handle end 116, thereby extending the collapsable sleeve 118 and the intermediate discs 124. At the furthest extent allowed by the collapsable sleeve 118, the second disc 122 engages a locking member 126, thereby retaining the second disc 122 at the locking position, and further maintaining the collapsable sleeve 118 in the deployed position so as to define an enlarged hitting profile. The locking member 126 can be any suitable form, such as a snap ring (not shown) attached to the second disc 122 which is engageable with a snap ring groove (not shown) on the elongated member 112.

This second embodiment retains it rigidity by way of the stiffness of the elongated member 112. In addition, the intermediate discs 124 maintain the collapsable sleeve 118 concentric with the elongated member 112, such that a semi-rigid hitting surface is provided in the portion of the collapsable bat 100 which defines the hitting profile.

In a third embodiment, a collapsable bat 200 is provided as shown in FIG. 7. Similar to the second embodiment described above, the third embodiment has an elongated member 212 with a handle end 216 and a hitting end 214. A first disc 220 is rigidly attached adjacent the hitting end 214. A second disc 222 is slidably mounted on the elongated member 212 between the handle end 216 and the first disc 220. A plurality of ribs 218 extend longitudinally between the first disc 220 and the second disc 222. A resilient cover 224 covers and encloses the ribs 218 to form a cylindrical cavity between the first disc 220 and the second disc 222.

The collapsable bat 200 is deployed by traversing the second disc 222 toward the first disc 220 as shown in FIG. 8. The second disc 222 is retained in the desired position by way of one or more suitable locking members 226, such as a spring-loaded pin (not shown), disposed on the elongated member 212 adjacent the handle end 216. As the second disc 222 is traversed toward the first disc 220, the ribs 218 arcuately bow radially away from the elongated member 212, thereby increasing the size of the hitting profile. As is the case with the second embodiment, the third embodiment derives its rigidity from the stiffness of the elongated member 112.

In a fourth embodiment of the present invention, there is provided a collapsable bat 300 comprised of an elongated member 312 having a handle end 316 and a hitting end 314. Located concentrically along the length of the elongated member 312 are a plurality of annular members, generally indicated as 318 in FIG. 10. The annular members 318 are slidably mounted to the elongated member 312 between the handle end 316 and the hitting end 314. The annular members 318 have incremental tapered diameters such that a composite diameter of the annular members 318 is tapered toward both the handle end 316 and the hitting end 314 as can be seen in FIG. 10. In this way, the largest annular member 320 is located intermediate the plurality the annular members 318, while the two annular members 322 and 324 with the smallest diameters are located adjacent the handle end 316 and the hitting end 314. The incremental tapered diameters of the annular members 318 are sized such that an incrementally smaller annular member can be telescopically inserted within an adjacent incrementally larger annular member. Consequently, all of the incrementally smaller annular members are capable of residing within the largest annular member 320, as shown in FIG. 9.

In use, the incrementally smaller annular members are telescopically extended toward both the handle end 316 and the hitting end 314 to form the hitting profile of the collapsable bat 300. To maintain concentricity between the annular members 318 and the elongated member 312, each annular member is provided with a radial wall 326 which concentrically locates each annular member 318 on the elongated member 312, as shown in FIG. 11. The taper to the diameters of the annular members 318 is such that an interference fit is provided between each incrementally smaller annular member with its adjacent incrementally larger annular member when the smaller member is extended. In this manner, the collapsable bat 300 remains deployed until a force is exerted longitudinally toward the largest annular member 320, as indicated in FIG. 10, to collapse the incrementally smaller annular members into their respective adjacent incrementally larger annular members.

Figure 13:
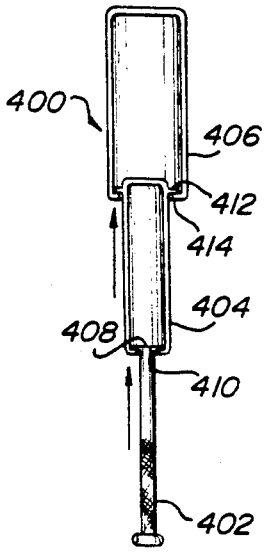
FIG. 13 is a pictorial view of the collapsable bat of FIG. 12 shown in an extended deployed condition.

A fifth embodiment of a collapsable bat in accordance with this invention is shown in FIGS. 12 and 13 and is designated by reference number 400. Bat 400 is comprised of a handle portion 402 with a pair of relatively telescoping hitting surface sections 404 and 406. As shown, handle portion 402 defines a radially projecting flange 408. A hole 410 in hitting surface section 404 is large enough to slide over handle portion 402, but prevents section 404 from being completely withdrawn. Similarly, hitting surface 404 defines projecting flange 412 which prevents hitting surface 406 from being completely withdrawn from section 404 through its hole 414. Preferably, the telescoping element of bat 400 frictionally engage with each other in their deployed condition to maintain the bat in that condition during use. FIG. 12 shows bat 400 in a completely collapsed condition, whereas when the hitting surfaces section 404 and 406 are withdrawn and telescoped outwardly an enlarged bat ready for use is provided as shown in FIG. 13.

Figure 14:
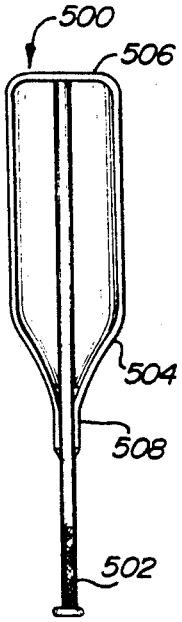
FIG. 14 is a cross-sectional view of a bat in accordance with a sixth embodiment of this invention shown in a normal storage condition.
Figure 15:
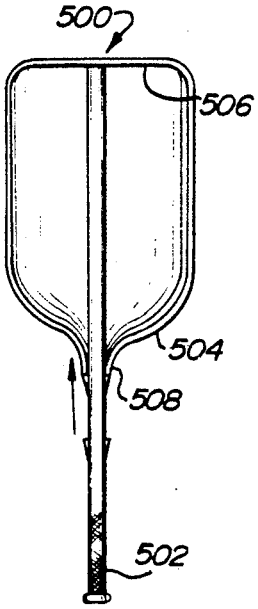
FIG. 15 is a cross-sectional view of the bat shown in FIG. 14 shown in a deployed condition.

An enlargeable bat in accordance with a sixth embodiment of this invention is shown in FIGS. 14 and 15 and is generally designated by reference number 500. Bat 500 defines an elongated handle portion 502 and the hitting surface made from a plurality of bow strips 504 which are attached integrally with a top plate 506 and extend downwardly to a sleeve 508 which is slideable along handle portion 502. Bow strips 504 are arranged to encircle handle portion 502. In FIG. 14, sleeve 508 is shown in a position to reduce the effective diameter of the combined bow strips 504, whereas FIG. 15 shows sleeve 508 slid toward top plate 506 causing bow strips 504 to expand thereby enlarging the hitting profile of bat 500. Barbed projections 510 and 512 are provided to maintain sleeve 508 in a desired position. A fabric mesh material (not shown) can be used to cover bow strips 504 if desired.

Figure 16:
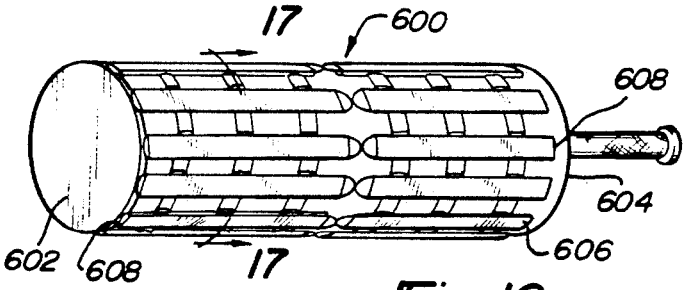
FIG. 16 is a pictorial view of a collapsable bat in accordance with a seventh embodiment of this invention.
Figure 17:
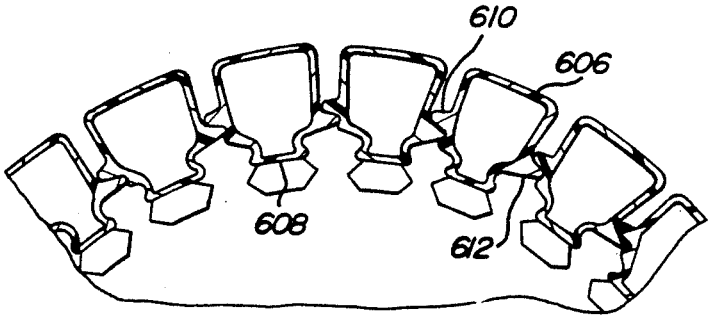
FIG. 17 is a partial cross-sectional view taken along lines 17—17 from FIG. 16.

A sport striking article in accordance with a seventh embodiment of this invention is shown in FIGS. 16 and 17 and is generally designated by reference number 600. Instrument 600 includes an end plate 602 and a base plate 604 with a number of strips 606 extending therebetween. The strips 606 have a living hinge 608 at their axial mid section allowing the unit to be folded as described in better detail below. In a deployed condition as shown in FIG. 16, strips 606 define interlocking projections as best shown in FIG. 17 so that when they are placed in closely packed condition they interlock to provide enhanced structure rigidity to the article 600 in its deployed condition. Further enhancement in the structural rigidity is provided through the use of strips 606 which define a closed hollow section. Furthermore, interlocking projections 610 and 612 fit together as shown in FIG. 17 to enhance structural rigidity of this article.

Figure 18:
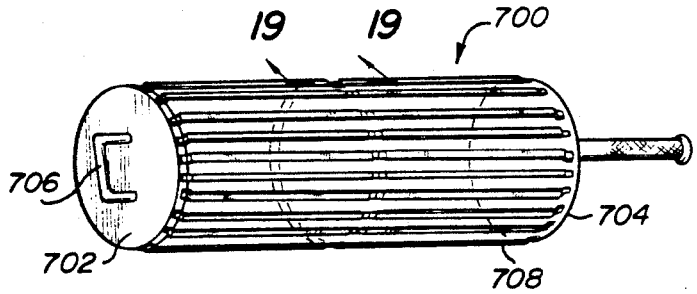
FIG. 18 is a pictorial view of a collapsable bat in accordance with a eighth embodiment of this invention.
Figure 19:
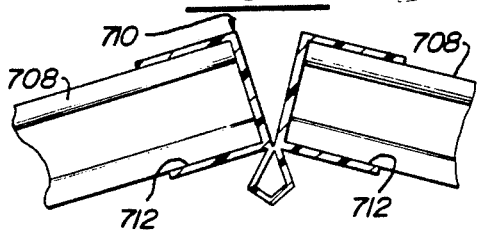
FIG. 19 is a partial cross-sectional view taken along 19 19 of FIG. 18.

FIG. 18 shows a sport striking instrument 700 in accordance with an eight embodiment of this invention which bears many similarities to the configuration of FIG. 16. Striking instrument 700, like the prior embodiment, includes a pair of separated plates including top plate 702 and base plate 704. Top plate includes the feature of an extending handle 706. Elongated strips 708 extend between top and base plates 702 and 704 and are hinged at their middle by hinge assembly 710, as best shown in FIG. 19. Hinge assembly 710 includes cupped shaped sockets 712 which receive the ends of strips 708. Preferably, hinge assemblies 710 include a tensioning mechanism which urges them toward a position where both joining strips 708 are aligned.

Figure 20:
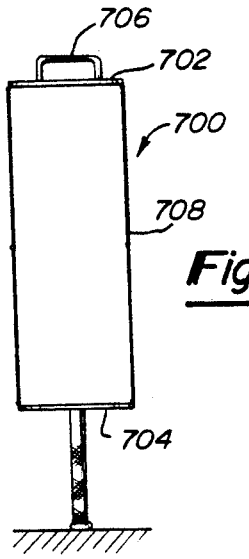
FIG. 20 is a simplified pictorial view of the bat of FIG. 18 shown in a normal deployed condition.
Figure 21:
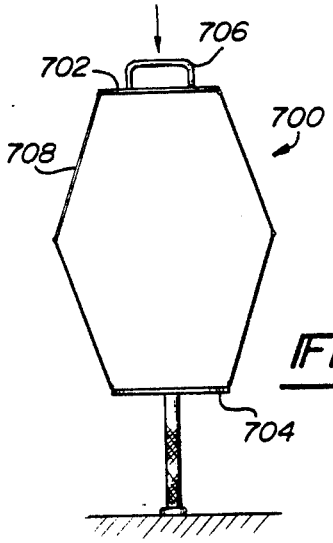
FIG. 21 shows the bat of FIG. 18 being collapsed at an initial stage of collapsing.
Figure 22:
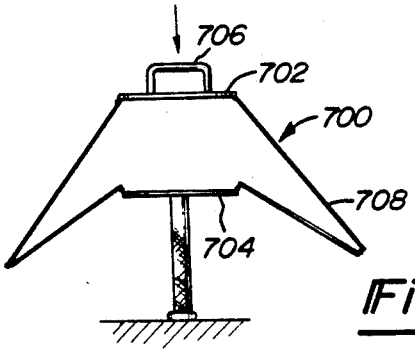
FIG. 22 shows the bat of FIG. 18 in nearly fully collapsed condition.
Figure 23:
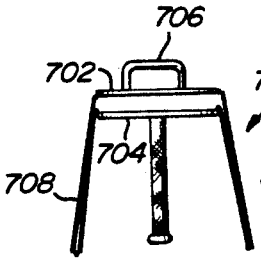
FIG. 23 shows the bat of FIG. 18 in a fully collapsed condition.

FIGS. 20 though 23 show striking instrument 700 in various conditions of being ready for use and being collapsed for a storage or merchandising. These figures are equally applicable to the configuration shown in FIGS. 16 and 17. FIG. 20 shows the unit fully extended with strips 708 in an aligned condition defining an enlarged diameter striking profile for use in playing a sports game. FIG. 21 illustrates a compressive loading being put on top plate 702 urging it towards base plate 704 which causes the strips 708 to bow outwardly. FIG. 22 shows the unit in nearly fully collapsed position with strip 708 folding to a position below base plate 704. FIG. 23 shows the device in a fully folded condition.

Throughout this specification, reference has been made to the sport striking article of this invention being used with specific sports games such as baseball or softball. It should be recognized that the principles of this invention could be adapted to a wide variety of various types of games including but not limited to court games such as tennis or badminton, as well as practice aids for various types of games. shapes, sizes, colors, densities and types of balls or moving objects could be used with the devices of this invention.

A significant advantage to each of the embodiments described above is that a child is provided with a bat that will greatly enhance the chances of he or she successfully hitting the ball. A further advantage is that the collapsable bat can be collapsed to a size that is readily storable. Furthermore, each of the embodiments described above provides a bat which is sufficiently rigid to hit a ball a reasonable distance.

While the invention has been described in terms of preferred embodiments, it is apparent that other forms could be adopted by one skilled in the art. Accordingly, the scope of the invention is to be limited only by the following claims.

What is claimed is:

1. A collapsable bat comprising:

an elongated member having a handle end and a hitting end;

a hitting profile defined by a diameter adjacent said hitting end, said hitting profile being that portion of said collapsable bat intended to strike a ball;

as cavity enclosed within said elongated member and adjacent said hitting end;

a plurality of slits disposed on said elongated member, said slits being contiguous with said cavity, said slits enabling said hitting profile to be selectively enlargeable; and an inflatable bladder residing within said cavity, said bladder having inflation means attached thereto for inflating and deflating said bladder;

wherein said cavity is enlarged as said bladder is inflated so as to enlarge said hitting profile, said hitting surfaces being displaced radially outward.

2. A collapsable bat as claimed in claim 1, wherein said slits are substantially longitudinal in relation to said elongated member.

3. A collapsable bat as claimed in claim 1, wherein said elongated member has an axial member that extends through said cavity.

* * * * *